US009484144B2

(12) United States Patent
Su et al.

(10) Patent No.: US 9,484,144 B2
(45) Date of Patent: Nov. 1, 2016

(54) TRANSFORMER ASSEMBLY STRUCTURE

(71) Applicant: DELTA ELECTRONICS, INC., Taoyuan Hsien (TW)

(72) Inventors: Yi-Che Su, Taoyuan Hsien (TW); Ming-Cheng Lee, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 45 days.

(21) Appl. No.: 14/475,188

(22) Filed: Sep. 2, 2014

(65) Prior Publication Data

US 2015/0179331 A1 Jun. 25, 2015

(30) Foreign Application Priority Data

Dec. 19, 2013 (TW) ..... 102147173 A

(51) Int. Cl.
*H01F 27/29* (2006.01)
*H01F 27/28* (2006.01)
*H01F 27/06* (2006.01)

(52) U.S. Cl.
CPC ..... *H01F 27/29* (2013.01); *H01F 27/2828* (2013.01); *H01F 2027/065* (2013.01)

(58) Field of Classification Search
CPC ..... H01F 5/00; H01F 27/00–27/30
USPC ..... 336/65, 83, 90, 92, 198, 192, 200, 232, 336/220–223
See application file for complete search history.

(56) References Cited

U.S. PATENT DOCUMENTS

| | | | | |
|---|---|---|---|---|
| 5,179,365 | A | 1/1993 | Raggi | |
| 2004/0041676 | A1* | 3/2004 | Okamoto | H01F 27/292 336/90 |
| 2011/0025441 | A1* | 2/2011 | Tien | H01F 17/062 336/65 |

FOREIGN PATENT DOCUMENTS

| | | |
|---|---|---|
| JP | 6-260341 | 9/1994 |
| JP | 9-45539 | 2/1997 |
| JP | 2006-278593 | 10/2006 |
| JP | 2008-235807 | 10/2008 |
| JP | 2010-50153 | 3/2010 |

* cited by examiner

*Primary Examiner* — Tuyen Nguyen
(74) *Attorney, Agent, or Firm* — Kirton McConkie; Evan R. Witt

(57) ABSTRACT

A transformer assembly structure includes a transformer and a carrying seat. The transformer includes a bobbin, a winding coil assembly and a magnetic core assembly. The winding coil assembly includes a primary winding coil and a secondary winding coil. The carrying seat includes a main body and a first lateral wing. The main body has an edge. The first lateral wing includes a first positioning structure. The edge of the main body of the carrying seat is located at an inner side of an outer edge of the magnetic core assembly. The outlet part of the primary winding coil is managed and positioned by the first positioning structure.

10 Claims, 7 Drawing Sheets

TRANSFORMER ASSEMBLY STRUCTURE

TECHNICAL FIELD

The present disclosure relates to a transformer assembly structure, and more particularly to a transformer assembly structure with a carrying seat for assisting in managing and positioning coils of a transformer.

BACKGROUND OF THE DISCLOSURE

A transformer is a magnetic device that transfers electric energy from one circuit to another circuit through coils in order to regulate an input voltage to a desired range for powering an electronic device. Conventionally, the transformer includes a bobbin, a magnetic core assembly, a primary winding coil, and a secondary winding coil. The primary winding coil and the secondary winding coil are wound around a winding section of the bobbin. During operations of the transformer, an input voltage is inputted into the primary winding coil, the magnetic core assembly is subject to electromagnetic induction, and a regulated voltage is outputted from the secondary winding coil.

FIG. 1A is a schematic exploded view illustrating a conventional transformer. FIG. 1B is a schematic perspective view illustrating the assembled structure of the transformer of FIG. 1A. As shown in FIGS. 1A and 1B, the conventional transformer 1 includes an insulation case 10, a bobbin 11, a magnetic core assembly 12, a primary winding coil (not shown), and a secondary winding coil 13. A positioning structure 101 is protruded from a sidewall of the insulation case 10. In addition, the positioning structure 101 has positioning holes 102. A process of assembling the conventional transformer 1 will be illustrated as follows. Firstly, the primary winding coil and the secondary winding coil 13 are wound on a winding section (not shown) of the bobbin 11. In addition, the outlet parts 131 of the secondary winding coil 13 are outputted from a lateral side of the bobbin 13. After the primary winding coil and the secondary winding coil 13 are wound on the bobbin 11, the bobbin 11 and the magnetic core assembly 12 are combined together. Then, the combination of the bobbin 11 and the magnetic core assembly 12 is placed in an accommodation space 100 of the insulation case 10. In addition, the outlet parts 131 of the secondary winding coil 13 are positioned in the corresponding positioning holes 102 of the insulation case 10. The resulting structure of the assembled transformer 1 is shown in FIG. 1B. For separating the primary winding coil from the secondary winding coil 13 and meeting the safety requirements, the transformer 1 is additionally equipped with the insulation case 10. As known, the arrangement of the insulation case 10 may increase isolation and creepage distance of the transformer 1 in order to enhance the electrical safety. However, the use of the insulation case 10 may increase the fabricating cost of the transformer 1 and increase the overall volume of the transformer 1.

FIG. 2 is a schematic perspective view illustrating another conventional transformer. As shown in FIG. 2, the transformer 2 includes a bobbin 21, a magnetic core assembly 22, a primary winding coil (not shown), and a secondary winding coil 23. In addition, the transformer 2 further includes an insulation tape 20. The function of the insulation tape 20 is similar to the function of the insulation case 10 of FIG. 1. The bobbin 21 further includes a base 211. The base 211 is extended from the bobbin 21 along an extending direction of the outlet parts 231 of the secondary winding coil 23. Moreover, the base 211 includes a positioning structure 212 for positioning the outlet parts 231 of the secondary winding coil 23. Moreover, the insulation tape 20 is wound around the bobbin 21, the magnetic core assembly 22, the primary winding coil and the secondary winding coil 23. Similarly, the insulation tape 20 may increase isolation of the transformer 2 in order to enhance the electrical safety. Since the insulation case is replaced by the insulation tape 20, the fabricating cost and the overall volume of the transformer 2 are reduced when compared with the transformer 1. However, since the base 211 with the positioning structure 212 are protruded from the bobbin 21, the length and height of the transformer 2 are still large. Under this circumstance, the applications of installing the transformer 2 on a circuit board (not shown) will be restricted.

Recently, the general trends in designing electronic device are toward small size, miniaturization and slimness. Correspondingly, the volume of the transformer for use in the electronic device should be reduced. In other words, the manufactures of transformers make efforts in reducing the thicknesses of the transformers. Moreover, for facilitating assemblage, the structure of the transformer should be as simple as possible. As previously described in FIG. 1, the transformer 1 uses the insulation case 10 for isolating the primary winding coil, the secondary winding coil 13 and the external electronic components from each other and positioning the outlet parts 131 of the secondary winding coil 13. The insulation case 10 may increase the length, width and height of the transformer 1. As previously described in FIG. 2, the insulation case is replaced by the insulation tape 20, and the base 211 is extended from the bobbin 21. However, the length and height of the transformer 2 are still large. In other words, the conventional transformers fail to meet the requirement of miniaturization and slimness.

Therefore, there is a need of providing an improved transformer in order to avoid the above drawbacks.

SUMMARY OF THE DISCLOSURE

The present disclosure provides a slim-type transformer assembly structure with a carrying seat for assisting in managing and positioning the winding coils of a transformer, in which the transformer assembly structure can be assembled in a labor-saving and cost-effective manner.

In accordance with an aspect of the present disclosure, there is provided a transformer assembly structure. The transformer assembly structure includes a transformer and a carrying seat. The transformer includes a bobbin, a winding coil assembly and a magnetic core assembly. The winding coil assembly includes a primary winding coil and a secondary winding coil. The primary winding coil and the secondary winding coil are wound around the bobbin. The bobbin is arranged between a first magnetic core and a second magnetic core of the magnetic core assembly. The carrying seat includes a main body and a first lateral wing. The main body has an edge. The first lateral wing includes a first positioning structure. The carrying seat is disposed on a bottom of the transformer. The edge of the main body of the carrying seat is located at an inner side of an outer edge of the magnetic core assembly. An outlet part of the primary winding coil is connected with the first positioning structure. Consequently, the outlet part of the primary winding coil is managed and positioned by the first positioning structure.

In accordance with another aspect of the present disclosure, there is provided a carrying seat. The carrying seat is disposed on a bottom of a transformer. The transformer includes a bobbin, a winding coil assembly and a magnetic core assembly. The winding coil assembly includes a primary winding coil and a secondary winding coil. The primary winding coil and the secondary winding coil are wound around the bobbin. The bobbin is arranged between a first magnetic core and a second magnetic core of the magnetic core assembly. The carrying seat includes a first lateral wing and a main body. The first lateral wing includes a first positioning structure. The main body is connected with the first lateral wing. An edge of the main body of the carrying seat is located at an inner side of an outer edge of the magnetic core assembly. An outlet part of the primary winding coil is connected with the first positioning structure. Consequently, the outlet part of the primary winding coil is managed and positioned by the first positioning structure.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
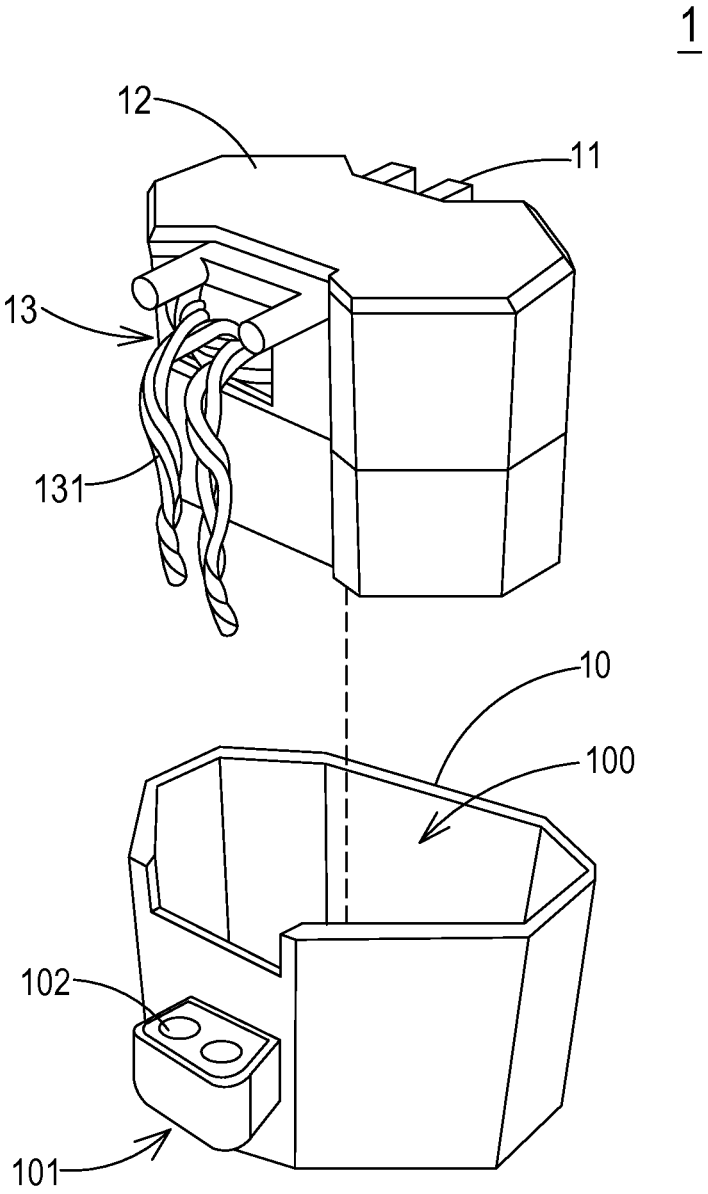
FIG. 1A (PRIOR ART)
FIG. 1A is a schematic exploded view illustrating a conventional transformer.
Figure 1B:
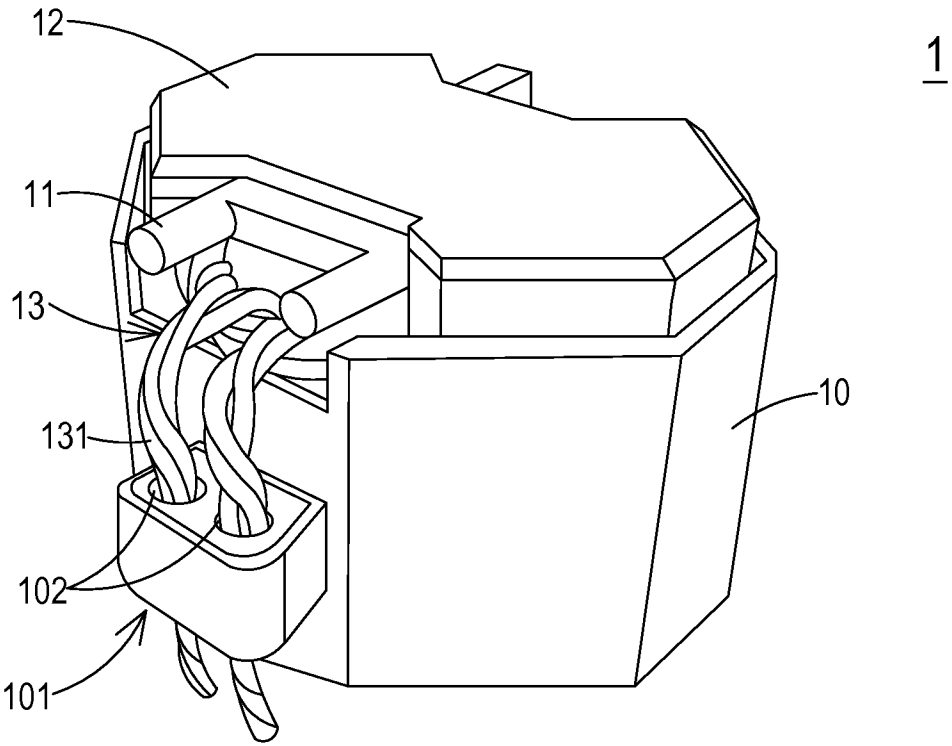
FIG. 1B (PRIOR ART)
FIG. 1B is a schematic perspective view illustrating the assembled structure of the transformer of FIG. 1A.
Figure 2:
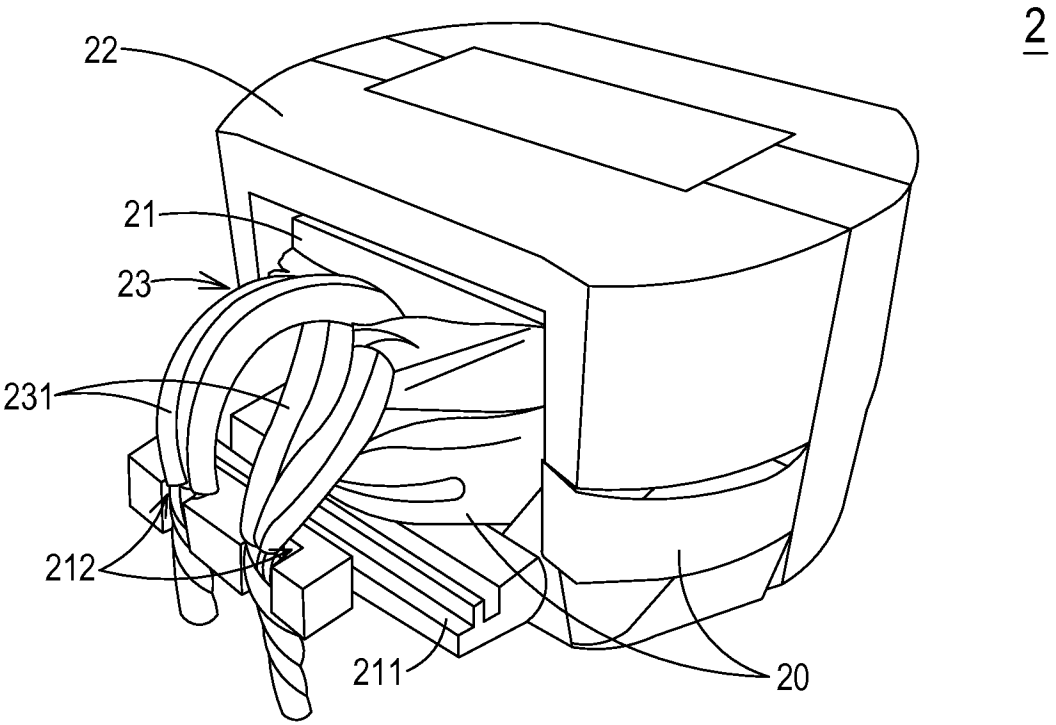
FIG. 2 (PRIOR ART)
FIG. 2 is a schematic perspective view illustrating another conventional transformer.
Figure 3:
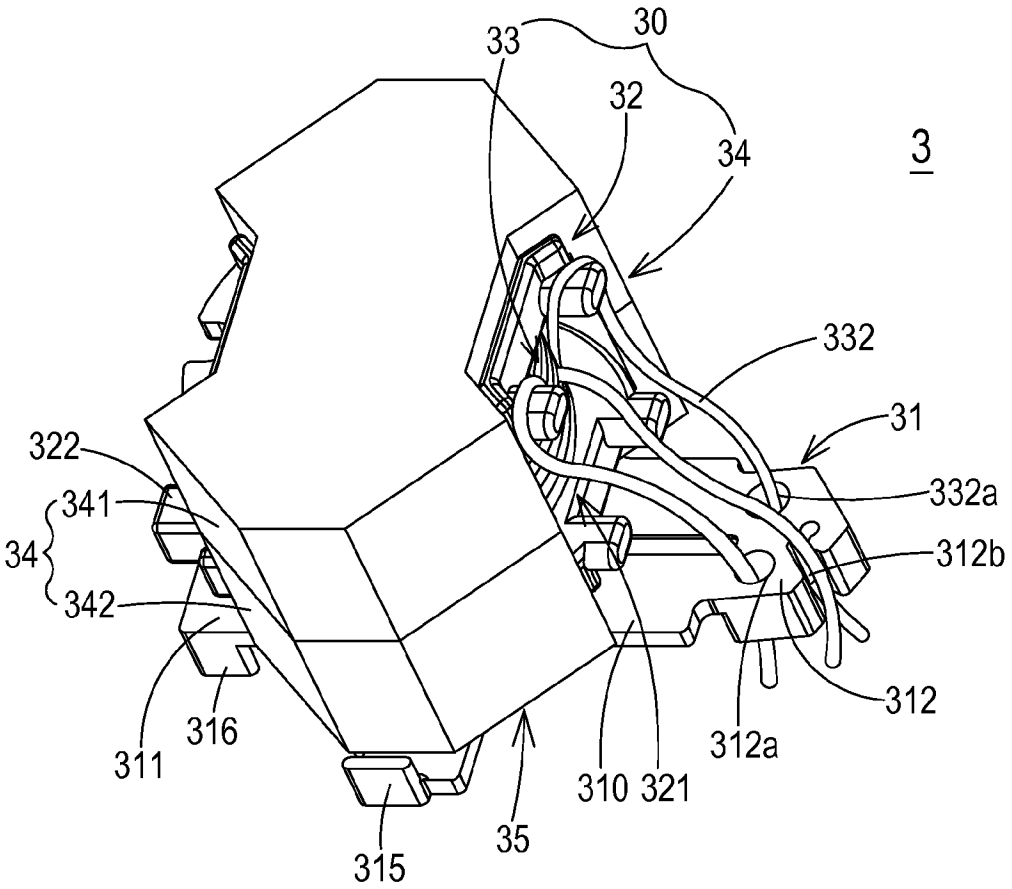
FIG. 3 is a schematic perspective view illustrating a transformer assembly structure according to an embodiment of the present disclosure.
Figure 4:
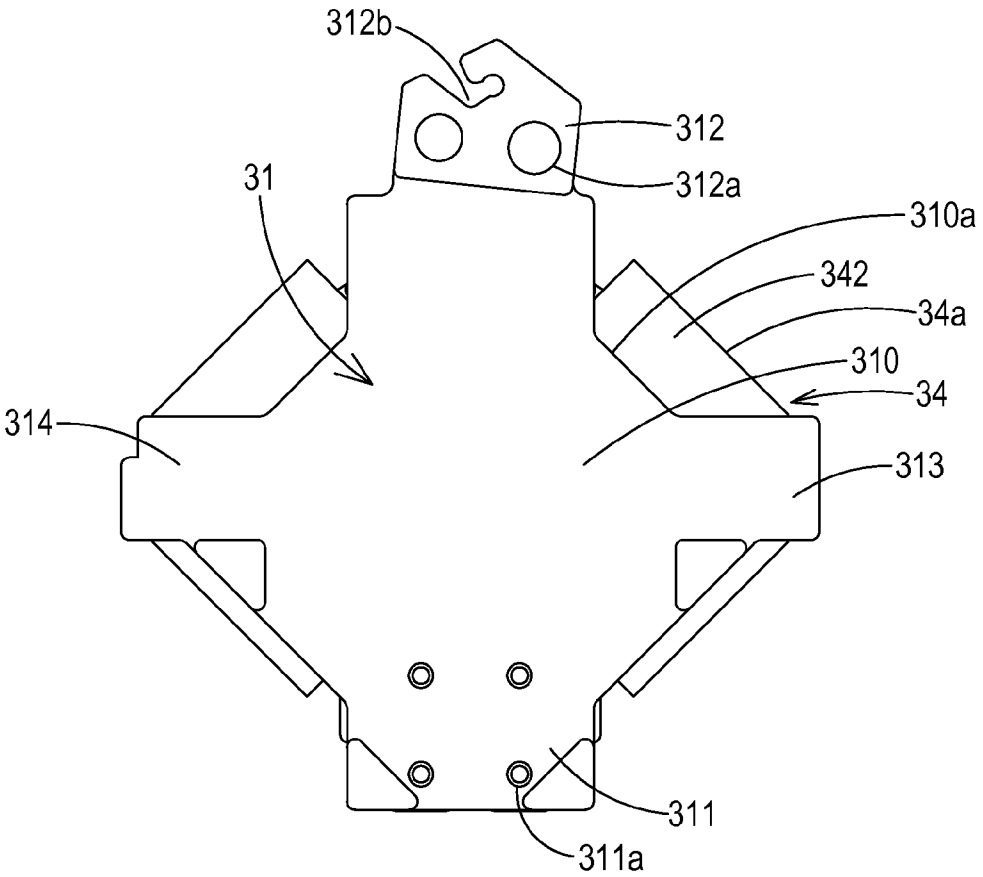
FIG. 4 is a schematic bottom view illustrating the carrying seat of the transformer assembly structure according to the embodiment of the present disclosure.
Figure 5:
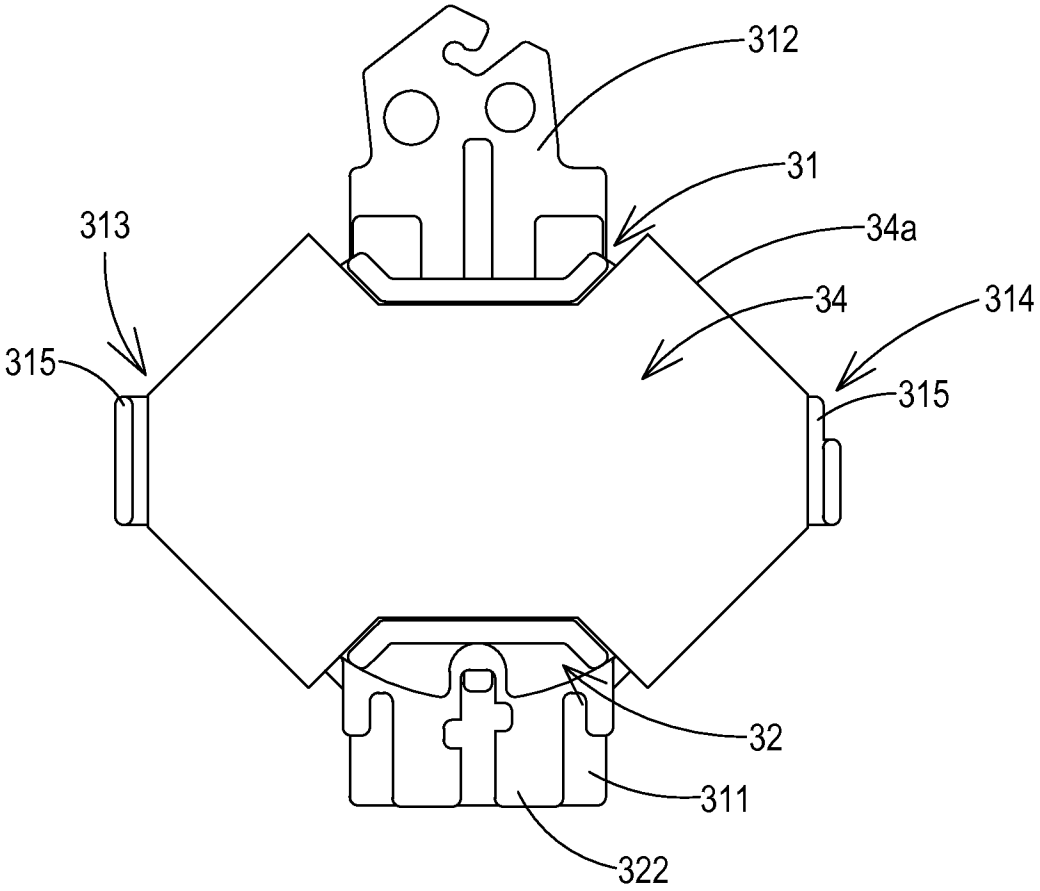
FIG. 5 is a schematic top view illustrating the transformer assembly structure according to the embodiment of the present disclosure.
Figure 6:
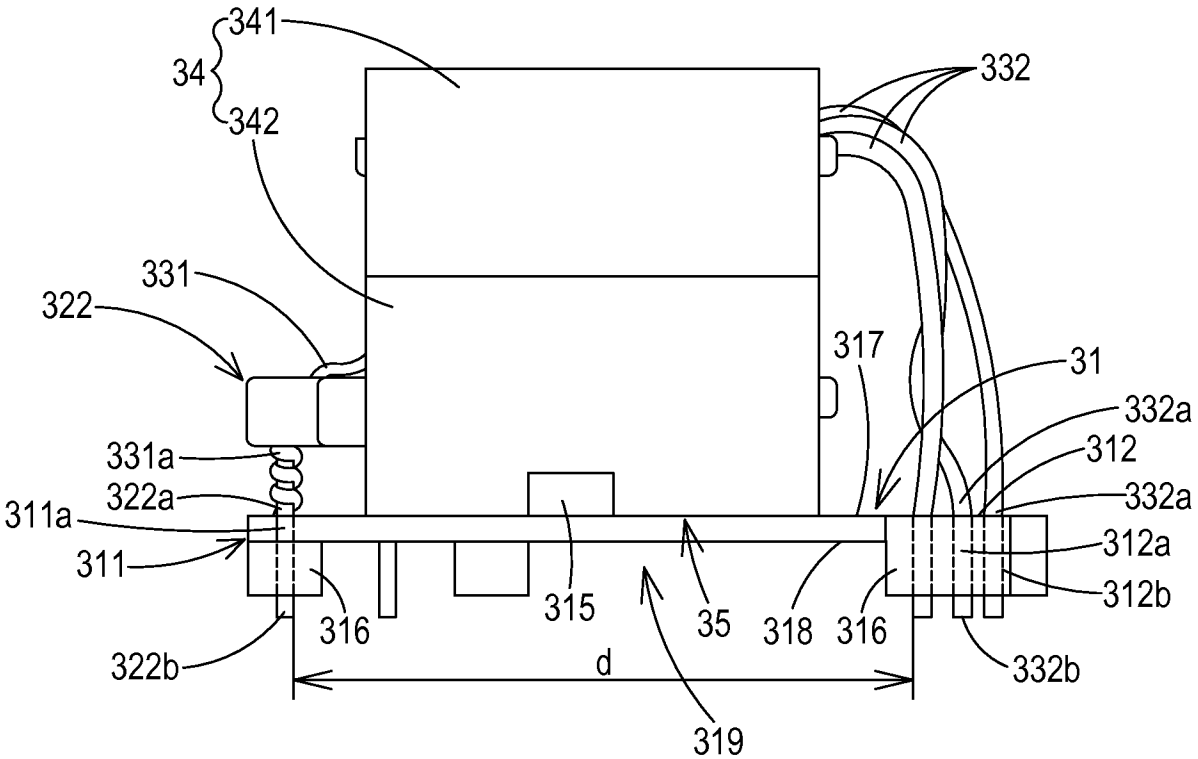
FIG. 6 is a schematic side view illustrating the transformer assembly structure according to the embodiment of the present disclosure.

FIG. 3 is a schematic perspective view illustrating a transformer assembly structure according to an embodiment of the present disclosure. FIG. 4 is a schematic bottom view illustrating the carrying seat of the transformer assembly structure according to the embodiment of the present disclosure. FIG. 5 is a schematic top view illustrating the transformer assembly structure according to the embodiment of the present disclosure. FIG. 6 is a schematic side view illustrating the transformer assembly structure according to the embodiment of the present disclosure.

As shown in FIGS. 3 and 4, the transformer assembly structure 3 includes a transformer 30 and a carrying seat 31. The transformer 30 includes a bobbin 32, a winding coil assembly 33, and a magnetic core assembly 34. The bobbin 32 includes a winding section 321. In this embodiment, the winding coil assembly 33 includes a primary winding coil 331 (see FIG. 6) and a secondary winding coil 332. The primary winding coil 331 includes outlet parts 331*a* (see FIG. 6). The secondary winding coil 332 includes outlet parts 332*a*. The primary winding coil 331 and the secondary winding coil 332 are wound around the winding section 321 of the bobbin 32. The magnetic core assembly 34 includes a first magnetic core 341 and a second magnetic core 342. After the winding coil assembly 33 is wound around the bobbin 32, the bobbin 31 is arranged between the first magnetic core 341 and the second magnetic core 342. Consequently, the transformer 30 is fabricated.

The carrying seat 31 includes a main body 310, a first lateral wing 311, a second lateral wing 312, a third lateral wing 313, and a fourth lateral wing 314. The first lateral wing 311 and the second lateral wing 312 are opposed to each other. The third lateral wing 313 and the fourth lateral wing 314 are opposed to each other. The third lateral wing 313 and the fourth lateral wing 314 are arranged between the first lateral wing 311 and the second lateral wing 312. The main body 310 has an edge 310*a*. The main body 310 is connected with the first lateral wing 311, the second lateral wing 312, the third lateral wing 313 and the fourth lateral wing 314 through the edge 310*a*. When the transformer 30 and the carrying seat 31 are combined together, a bottom 35 of the transformer 30 is disposed on the carrying seat 31, and the edge 310*a* of the main body 310 of the carrying seat 31 is located at an inner side of an outer edge 34*a* of the magnetic core assembly 34. In this embodiment, the carrying seat 31 is a flat plate. Moreover, the first lateral wing 311, the second lateral wing 312, the third lateral wing 313 and the fourth lateral wing 314 are integrally formed with the main body 310.

The first lateral wing 311 of the carrying seat 31 includes a plurality of first positioning structures 311*a* (see also FIG. 6). In this embodiment, the first positioning structures 311*a* are perforations, but are not limited thereto. The first positioning structures 311*a* are used for positioning the outlet parts 331*a* of the primary winding coil 331 of the transformer 30 (see also FIG. 6). The second lateral wing 312 of the carrying seat 31 includes a plurality of second positioning structures 312*a*. In this embodiment, the second positioning structures 312*a* are also perforations, but are not limited thereto. The second positioning structure 312*a* is used for positioning the outlet parts 332*a* of the secondary winding coil 332 of the transformer 30. In accordance with the present disclosure, there is a specified distance d between the first positioning structure 311*a* and the second positioning structure 312*a* (see FIG. 6). Consequently, the outlet parts 331*a* and the outlet parts 332*a* are separated from each other in order to meet the safety requirements. Moreover, the second lateral wing 312 of the carrying seat 31 further includes a third positioning structure 312*b*. According to the practical requirements, the third positioning structure 312*b* may be a notch or an opening.

Please refer to FIGS. 3, 4 and 6. In this embodiment, the first lateral wing 311 includes four first positioning structures 311*a* (e.g. four perforations). These four first positioning structures 311*a* are arranged in a 2×2 array. Moreover, an extension part 322 is extended from a lateral side of a lower part of the bobbin 32. Moreover, a plurality of pins 322*a* are protruded from the extension part 322. Moreover, after the primary winding coil 331 of the winding coil assembly 33 is wound around the bobbin 32, the primary winding coil 331 is outputted from the extension part 322 of the bobbin 32, and the outlet parts 331*a* of the primary winding coil 331 are soldered on the corresponding pins 322*a*. Moreover, after the outlet parts 331*a* of the primary winding coil 331 are soldered on the corresponding pins 322*a*, the pins 322*a* are positioned by the first positioning structures 311*a*. That is, the pins 322*a* are penetrated through the four perforations of the first positioning structures 311*a*, and the tips 322*b* of the pins 322*a* are exposed outside the carrying seat 31. Consequently, after the pins 322*a* are inserted into corresponding insertion holes of a circuit board (not shown), the transformer 30 is electrically connected with the circuitry of the circuit board.

It is noted that numerous modifications and alterations may be made while retaining the teachings of the disclosure. For example, in some embodiments, the outlet parts 331*a* of the primary winding coil 331 of the transformer 30 are directly penetrated through the perforations of the first positioning structures 311*a* without the need of passing through the extension part 322 of the bobbin 32 and the auxiliary of the pins 322*a*. Under this circumstance, the first positioning structures 311*a* is also used for positioning the outlet parts 331*a* of the primary winding coil 331. Alternatively, in some other embodiments, the first positioning structures 311*a* are protrusion posts (not shown) that are protruded from the first lateral wing 311 of the carrying seat 31. Consequently, the outlet parts 331*a* of the primary winding coil 331 of the transformer 30 may be directly soldered on the protrusion posts (i.e. the first positioning structures 311*a*). Similarly, the first positioning structures 311*a* may assist in positioning the outlet parts 331*a*. In other words, the first positioning structures 311*a* of the carrying seat 31 have many variant examples. The ways of connecting the first positioning structures 311*a* with the outlet parts 331*a* of the primary winding coil 331 may be varied according to the practical requirements.

Please refer to FIGS. 3, 4 and 6 again. In this embodiment, the secondary winding coil 332 is a three-strand wire. Two outlet parts 332*a* of the secondary winding coil 332 are penetrated through the corresponding second positioning structures 312*a* (e.g. perforations) of the second lateral wing 312 of the carrying seat 31. Moreover, the tips 332*b* of the outlet parts 332*a* are exposed outside the carrying seat 31. Consequently, after the outlet parts 332*a* are inserted into corresponding insertion holes of a circuit board (not shown), the transformer 30 is electrically connected with the circuitry of the circuit board. Moreover, the third outlet part 332*a* of the secondary winding coil 332 is locked in the third positioning structure 312*b* (e.g. a notch) of the second lateral wing 312 of the carrying seat 31. In case that the third positioning structure 312*b* is an opening, the third outlet part 332*a* of the secondary winding coil 332 is penetrated through the third positioning structure 312*b*. In other words, the three outlet parts 332*a* of the secondary winding coil 332 may be positioned by the second positioning structures 312*a* and the third positioning structure 312*b*. Alternatively, in some other embodiments, the second positioning structures 312*a* and the third positioning structure 312*b* are protrusion posts (not shown) that are protruded from the second lateral wing 312 of the carrying seat 31. Consequently, the outlet parts 332*a* of the secondary winding coil 332 of the transformer 30 may be directly soldered on the protrusion posts (i.e. the second positioning structures 312*a* and the third positioning structure 312*b*). In other words, the second positioning structures 312*a* and the third positioning structure 312*b* of the carrying seat 31 have many variant examples. The ways of connecting the second positioning structures 312*a* and the third positioning structure 312*b* with the outlet parts 332*a* of the secondary winding coil 332 may be varied according to the practical requirements.

Please refer to FIG. 4 again. After the carrying seat 31 and the transformer 30 are combined together, the edge 310*a* of the main body 310 of the carrying seat 31 is located at an inner side of the outer edge 34*a* of the magnetic core assembly 34. In other words, the use of the carrying seat 31 may reduce the size of the outer case of the transformer 30. In other words, the overall volume of the transformer assembly structure 3 is reduced when compared with the conventional technology. In addition, the material cost of the carrying seat 31 is reduced.

Please refer to FIG. 5. In this embodiment, the carrying seat 31 includes two auxiliary positioning parts 315. The two auxiliary positioning parts 315 are disposed on the third lateral wing 313 and the fourth lateral wing 314 of the carrying seat 31, respectively. The number of the auxiliary positioning parts 315 and the locations of the auxiliary positioning parts 315 are not restricted. In this embodiment, the auxiliary positioning parts 315, the main body 310, the first lateral wing 311, the second lateral wing 312, the third lateral wing 313 and the fourth lateral wing 314 are integrally formed with each other. Please also refer to FIGS. 3 and 6. The auxiliary positioning parts 315 are protruded upwardly from a first surface 317 of the carrying seat 31 for assisting in positioning the magnetic core assembly 34. Due to the auxiliary positioning parts 315, the magnetic core assembly 34 is not rotated during the process of assembling the transformer 30 and the carrying seat 31. Consequently, the outlet parts of the primary winding coil 331 and the secondary winding coil 332 will not be hindered by the rotated magnetic core assembly 34. In other words, since the magnetic core assembly 34 is stopped by the auxiliary positioning parts 315 of the carrying seat 31 or the magnetic core assembly 34 is in contact with the auxiliary positioning parts 315, the movement of the magnetic core assembly 34 is limited. In other words, the auxiliary positioning parts 315 may assist in positioning the magnetic core assembly 34 and facilitate managing and positioning the coils.

Please refer to FIG. 6 again. In this embodiment, the carrying seat 31 further includes at least one supporting part 316. The supporting part 316 is disposed on a second surface 318 of the carrying seat 31, wherein the second surface 318 is opposed to the first surface 317. By the supporting part 316, the altitude of the carrying seat 31 is increased. Consequently, an accommodation space 319 is formed between the second surface 318 of the carrying seat 31 and the supporting part 316. Under this circumstance, since more small-sized electronic components may be accommodated within the accommodation space 319 under the carrying seat 31, the available circuitry space of the circuit board is enhanced. For example, the electronic component is a surface mount device (SMD), an integrated circuit (IC), a diode or a capacitor. Similarly, in this embodiment, the supporting part 316, the main body 310, the first lateral wing 311, the second lateral wing 312, the third lateral wing 313 and the fourth lateral wing 314 are integrally formed with each other.

Hereinafter, a process of fabricating the transformer assembly structure of the present disclosure will be illustrated with reference to FIGS. 3 and 6. Firstly, the winding coil assembly 33 is wound around the bobbin 32. Then, the winding coil assembly 33 is fixed and insulated by an insulation medium (e.g. an insulation tape, not shown). In addition, the outlet parts 331*a* of the primary winding coil 331 and the outlet parts 332*a* of the secondary winding coil 332 are outputted from bilateral sides of the bobbin 32. Then, part of the first magnetic core 341 and part of the second magnetic core 342 are disposed in the bobbin 31, so that the bobbin 31 is arranged between the first magnetic core 341 and the second magnetic core 342. Then, another insulation medium (e.g. an insulation tape, not shown) is wrapped around the magnetic core assembly 34 in order to isolate the magnetic core assembly 34 from other components. Consequently, the transformer 30 can meet the safety requirements. Then, the carrying seat 31 is combined with the bottom 35 of the transformer 30. Moreover, the outlet parts 331*a* of the primary winding coil 331 are connected with the first positioning structures 311*a*, and the outlet parts 332*a* of the secondary winding coil 332 are connected with the second positioning structures 312*a* and the third positioning structure 312*b*. In addition, the first positioning structure 311*a* and the second positioning structure 312*a* are separated from each other by the specified distance d. Consequently, the electrical safety of the transformer is enhanced. Meanwhile, the transformer assembly structure 3 is fabricated. Since the transformer assembly structure 3 is not equipped with the insulation case of the conventional transformer, the volume of the transformer of the present disclosure is reduced. Moreover, due to the positioning structures 311 a, 312*a* and 312*b* of the carrying seat 31, the outlet parts 331*a* of the primary winding coil 331 and the outlet parts 332*a* of the secondary winding coil 332 are effectively managed and positioned. Consequently, the efficiency of producing the product is increased. Moreover, in case that the third positioning structure 312*b* is a notch, the outlet part 332*a* of the secondary winding coil 332 may be positioned by the third positioning structure 312*b* more easily. Moreover, in case that the outlet part 332*a* of the secondary winding coil 332 is locked in the notch, the possibility of escaping from the notch will be minimized. Since the altitude of the carrying seat 31 is increased by the supporting part 316, the space utilization is enhanced. Under this circumstance, since more electronic components may be accommodated within the accommodation space under the carrying seat 31, the available circuitry space of the circuit board is enhanced.

From the above descriptions, the present disclosure provides a transformer assembly structure. The transformer assembly structure includes a transformer and a carrying seat. The transformer includes a bobbin, a winding coil assembly and a magnetic core assembly. The outlet parts of the primary winding coil and the outlet parts of the secondary winding coil can be effectively managed and positioned by the carrying seat. Since the carrying seat is a flat plate and the edge of the main body of the carrying seat is located at an inner side of an outer edge of the magnetic core assembly, the material cost is reduced than the conventional technology. Moreover, since the transformer assembly structure is not equipped with the insulation case of the conventional transformer, the volume of the transformer of the present disclosure is reduced. Moreover, since the outlet parts of the winding coils are effectively managed and positioned by many positioning structures, the efficiency of producing the product is increased and the time cost is reduced. When compared with the conventional transformer, the transformer assembly structure of the present disclosure has reduced volume and is easily fabricated. Moreover, the transformer assembly structure of the present disclosure can meet the requirement of slimness and the space utilization is also enhanced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A carrying seat disposed on a bottom of a transformer, the transformer comprising a bobbin, a winding coil assembly and a magnetic core assembly, the winding coil assembly comprising a primary winding coil and a secondary winding coil, the primary winding coil and the secondary winding coil being wound around the bobbin, the bobbin being arranged between a first magnetic core and a second magnetic core of the magnetic core assembly, the carrying seat comprising:

a first lateral wing comprising a first positioning structure; and a main body connected with the first lateral wing, wherein an edge of the main body of the carrying seat is located at an inner side of an outer edge of the magnetic core assembly, wherein an outlet part of the primary winding coil is connected with the first positioning structure, so that the outlet part of the primary winding coil is managed and positioned by the first positioning structure.

2. The carrying seat according to claim 1, further comprising a second lateral wing connected with the main body, wherein the first lateral wing and the second lateral wing are opposed to each other with respect to the main body, the second lateral wing comprises a second positioning structure, an outlet part of the secondary winding coil is connected with the second positioning structure, the first positioning structure and the second positioning structure are separated from each other by a specified distance so that the outlet part of the secondary winding coil is managed and positioned by the second positioning structure.

3. The carrying seat according to claim 2, wherein the second lateral wing of the carrying seat further comprises a third positioning structure.

4. The carrying seat according to claim 3, wherein each of the first positioning structure, the second positioning structure and the third positioning structure includes at least one perforation.

5. The carrying seat according to claim 3, wherein the third positioning structure is a notch, and the outlet part of the secondary winding coil is locked in the notch, so that the outlet part of the secondary winding coil is positioned by the notch.

6. The carrying seat according to claim 2, wherein the carrying seat further comprises a third lateral wing and a fourth lateral wing, wherein the third lateral wing and the fourth lateral wing are opposed to each other with respect to the main body, and the third lateral wing and the fourth lateral wing are arranged between the first lateral wing and the second lateral wing.

7. The carrying seat according to claim 6, wherein the carrying seat comprises two auxiliary positioning parts, which are disposed on the third lateral wing and the fourth lateral wing of the carrying seat, respectively, wherein the two auxiliary positioning parts are protruded from a first surface of the carrying seat for assisting in positioning the magnetic core assembly.

8. The carrying seat according to claim 7, wherein the main body, the first lateral wing, the second lateral wing, the third lateral wing, the fourth lateral wing and the two auxiliary positioning parts are integrally formed with each other.

9. The carrying seat according to claim 1, wherein the carrying seat further comprises at least one supporting part, wherein the at least one supporting part is disposed on a second surface of the carrying seat, and an altitude of the carrying seat is increased by the at least one supporting part, so that an accommodation space is formed under the carrying seat.

10. The carrying seat according to claim 9, wherein the at least one supporting part is integrally formed with the carrying seat.

* * * * *